US005498191A

United States Patent [19]

DeMars

[11] Patent Number: 5,498,191

[45] Date of Patent: Mar. 12, 1996

[54] BUBBLE PRODUCING TOY

[76] Inventor: Robert A. DeMars, 5000 N. Parkway Calabasas- Suite 233, Calabasas, Calif. 91302

[21] Appl. No.: 391,104

[22] Filed: Feb. 21, 1995

[51] Int. Cl.[6] ..... A63H 33/28; A63H 33/40

[52] U.S. Cl. ..... 446/015; 446/178

[58] Field of Search ..... 446/15, 16, 17, 446/18, 90, 20, 21, 178, 182, 194, 195, 267, 475, 483, 484

[56] References Cited

U.S. PATENT DOCUMENTS

| | | | |
|---|---|---|---|
| 2,393,039 | 1/1946 | Gilchrist, Jr. | 446/17 |
| 2,675,641 | 4/1954 | Baggott | 446/18 |
| 2,974,438 | 3/1961 | Hopkins | 446/16 |
| 2,989,818 | 6/1961 | Filger et al. | 446/20 |
| 3,775,899 | 12/1973 | Wolf | 446/17 |
| 3,814,394 | 6/1974 | Murray | 446/15 X |
| 4,423,565 | 1/1984 | Bart | 446/16 |
| 5,224,892 | 7/1993 | Messina | 446/15 |
| 5,224,893 | 7/1993 | Routzong et al. | 446/15 |
| 5,366,402 | 11/1994 | Rudell et al. | 446/16 |

FOREIGN PATENT DOCUMENTS

| | | | |
|---|---|---|---|
| 5-285278 | 11/1993 | Japan | 446/15 |
| 3015810 | 8/1993 | WIPO | 446/15 |

*Primary Examiner*—Robert A. Mafer
*Assistant Examiner*—D. Neal Muir
*Attorney, Agent, or Firm*—Jack C. Munro

[57] ABSTRACT

A hand holdable bubble producing toy that, when activated by the user, produces a stream of bubbles. Activation of the toy is accomplished by manually moving of a trigger which electrically operates a fan and a pump as well as a film producing mechanism in order to produce the dispensed bubbles and includes a collection system for recycling unused bubble solution.

15 Claims, 3 Drawing Sheets

BUBBLE PRODUCING TOY

BACKGROUND OF THE INVENTION

1. Field of the Invention

The field of this invention relates to toys and more particularly to a hand holdable toy to be normally used by a child that dispenses a stream of air bubbles from a liquid such as a soap solution.

2. Description of the Prior Art

Trigger actuated toys, generally in the form of a pistol or a rifle, are in exceedingly common usage. Such toys can be used to make noise and not propel an object from the toy. Also such toys can propel harmless objects such as corks, plastic slugs or water.

Another type of toy is a hand holdable ring which is to be inserted within a liquid solution such as a soap solution which places a film across the ring and when blown upon with air by the child, produces one or several air bubbles. Prior to the present invention, there are trigger actuated toys which are required to be dipped into a reservoir and also a toy with a windmill of rings which are to be dipped into a reservoir. These toys are prone to dipping and spilling. A toy emitting a steady stream of air bubbles made from a closed fluid system which contains and controls the fluid and is designed to eliminate or minimize spillage during handling of the toy would provide an exciting toy to the child and please any parent.

SUMMARY OF THE INVENTION

The bubble producing toy of the present invention is located within a hand holdable housing which includes a manually movable trigger. Within the internal chamber of the housing there is located a battery driven electrical motor attached to a fan which is activated by operation of the trigger. The trigger also activates simultaneously a film producing mechanism. Operation of the motor produces movement of air outward by means of the fan and also movement of a film making liquid from a reservoir by means of a pump to feed the film producing mechanism. The film producing mechanism includes an applicating bar which is held against the outer face of the sleeve. It is the function of the applicating bar to create a thin film of the liquid across the face of the sleeve as the applicator bar is moved relative to the sleeve. Both the air and the liquid, in the form of a film, come together at a sleeve mounted within a dispensing opening of the housing to the ambient. The thin film, when blown against the air from the fan, produces one or more air bubbles.

The primary objective of the present invention is to construct an entertaining and safe toy for a child which is triggered as is any firearm but which discharges a steady stream of harmless air bubbles.

Another objective of the present invention is to construct a bubble producing toy which is capable of being manufactured at a reasonable cost and therefore sold to the ultimate consumer at a reasonable cost.

Another objective of the present invention is to provide a bubble producing toy which recovers surplus film making liquid and is designed to prevent spillage or leaking of the liquid solution which might be displeasing to users.

DETAILED DESCRIPTION OF THE PREFERRED EMBODIMENT

Figure 1:
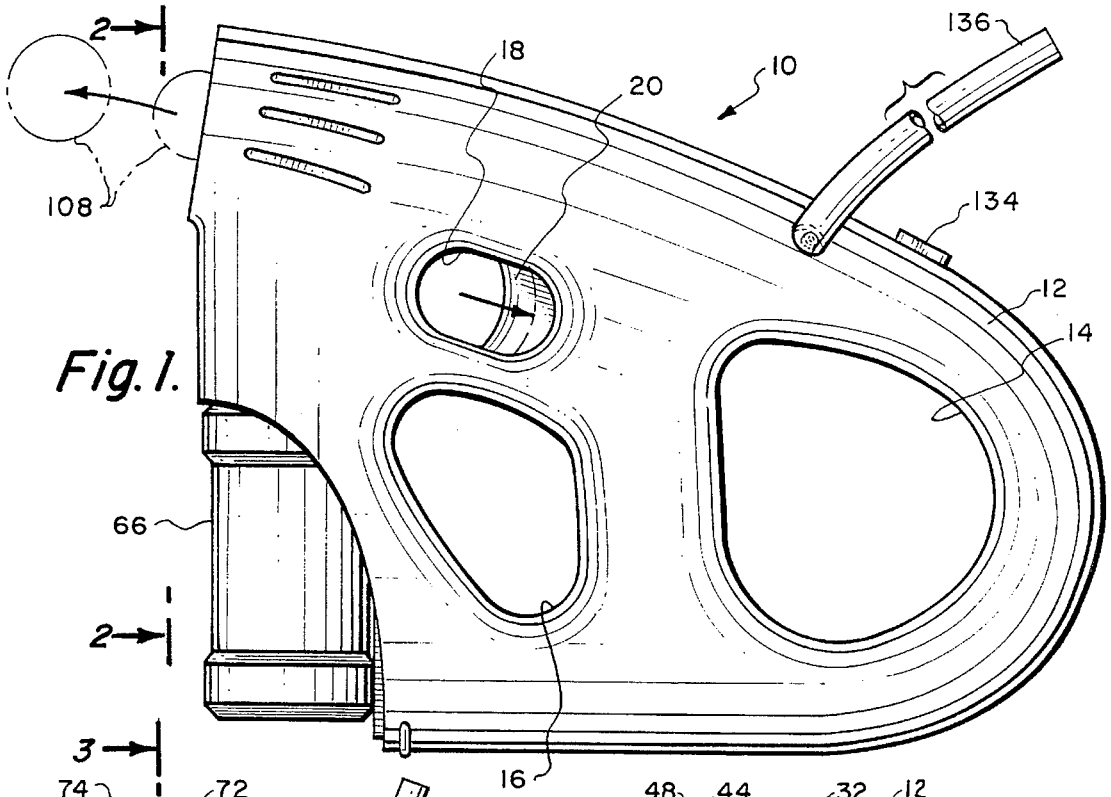
FIG. 1 is a side elevational view of the bubble producing toy of the present invention depicting dispensing of a series of bubbles.

A bubble is defined as a small globule of gas in a thin liquid envelope. Children have long used a liquid solution to produce bubbles. A common form of such a liquid solution is water combined with a detergent or soap. The detergent or soap lowers the surface tension of the water permitting a small quantity of the liquid to be stretched across an enclosing device such as a ring. When air is propelled into this film, the film breaks free of the ring and encloses a quantity of the air producing a bubble. Although a soapy water has been found to be a desirable form for such a liquid, other liquids could be utilized or water combined with other substances such as glycerin. However, one function of glycerin is for the purpose of extending the life of any produced air bubble.

Referring particularly to the drawings, there is shown the bubble producing toy 10 of this invention. The bubble producing toy 10 includes an exterior sheet material plastic housing 12 which includes an enlarged opening 14 and a smaller sized opening 16. The user, when holding the toy 10 of this invention, will normally place the palm of the user's hand (not shown) between the opening 14 and the opening 16 and the fingers (with the exception of the thumb and forefinger) within the smaller sized opening 16. The forefinger, which is frequently called the trigger finger, is to be located within the trigger opening 18 and the thumb in the enlarged opening 14. Movably mounted within the trigger opening 18 is a lineally movable trigger 20.

The housing 12 includes an internal chamber 22. The trigger 20 is movably mounted against the bias of a coil spring 24. The trigger 20 is shown in its normally at-rest position in FIG. 3 and in its maximum moved position in FIG. 7. The outer end of the coil spring 24 is mounted against motor housing 26. The motor housing 26 is fixedly positioned relative to the housing 12. Included within the motor housing 26 is an electrically operated motor, with this motor being driven by means of batteries 28 which are mounted within battery holder 30 with this battery holder in turn being fixedly secured to the wall of the internal chamber 22. An electrical contact 32 is mounted on the trigger 20. The electrical contact 32 rests against contact board 34. Mounted on the contact board 34 are three separate contacts which are connected by wires 36, 38 and 40 to an electrical circuit board 42. Upon the electrical contact 32 being located in electrical connection with the wire 36, the motor located within the motor housing 26 will be driven at the slowest possible speed. When the electrical contact 34 is connected with the wire 38, the motor located within the motor housing 26 will be driven at an intermediate speed. Also if the electrical contact 32 is connection with the wire 40, the motor mounted within the motor housing 26 will be operated at the fastest possible speed.

The motor mounted within the motor housing 26 has a through shaft 44 one end of which has physically mounted thereon a centrifugal fan blade 46. The opposite end of the shaft 44 has mounted thereon a worm gear 48. The worm gear 48 is in continuous engagement with a spur gear 50. The spur gear 50 is fixedly mounted on an elongated shaft 52. The aft end of the shaft 52 is mounted within bearing assembly 54 which is fixedly positioned on the housing 12. The front end of the shaft 52 is connected to a pump housing 56. Mounted within the pump housing 56 is a peristaltic pump (not shown) which includes a wheel upon which are mounted a plurality of rollers with only a single roller 58 being shown. One of the rollers, including roller 58, is in continuous contact with an elastomeric tube 60.

Elastomeric tube 60 connects to a suction tube 61 which extends through a cap 62. Cap 62 is fixedly mounted to the wall surface of the internal chamber 22 and includes screw threads 64 which threadingly engage, in a removable manner, with the screw threads around the open upper end of a reservoir 66. Included within the reservoir 66 is a quantity of a liquid 68. Suction tube 61 is to extend directly adjacent to the bottom 70 of the reservoir 66. Power from the motor mounted within motor housing 26 is transferred to the pump mounted in the pump housing 56 by means of the shaft 52 and additional gearing (not shown) causing the rollers 58 to move along the portion of the elastomeric tube 60 contained within the pump housing 56 in one direction, thus displacing some of the liquid 68 from within the reservoir 66 to the upper end of the tube 60 which is connected to connector 72. Connector 72 is integrally mounted onto a sleeve 74. The liquid 68 is to be conducted through a through hole 73 provided within the connector 72 to be deposited within annular chamber 76 which is located between the sleeve 74 and a sleeve insert 78 which is mounted within the sleeve 74. The sleeve insert 78 includes an enlarged center through opening 80.

Figure 2:
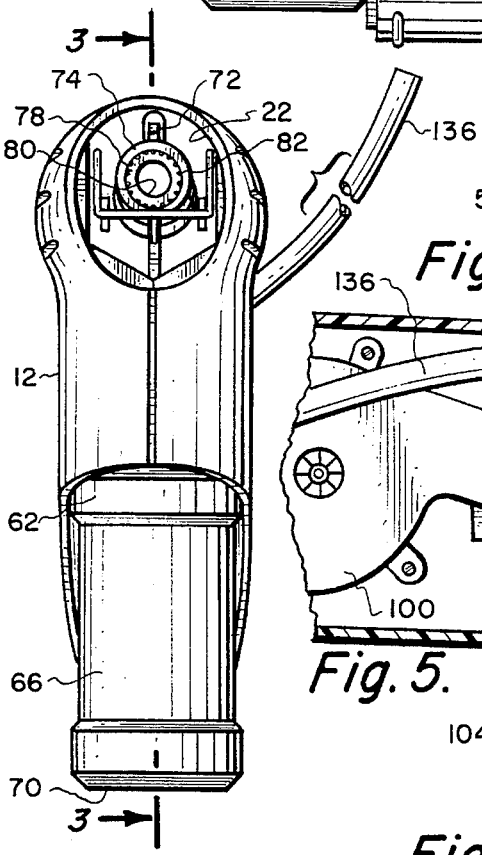
FIG. 2 is a front view of the bubble producing toy of the present invention taken along line 2—2 of FIG. 1.
Figure 4:
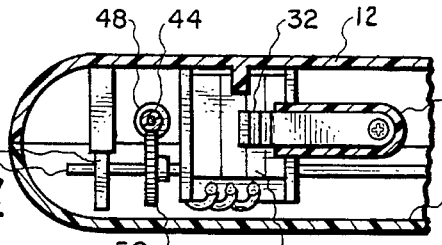
FIG. 4 is a cross-sectional view through the trigger of the bubble producing toy of the present invention taken along line 4—4 of FIG. 3.
Figure 5:
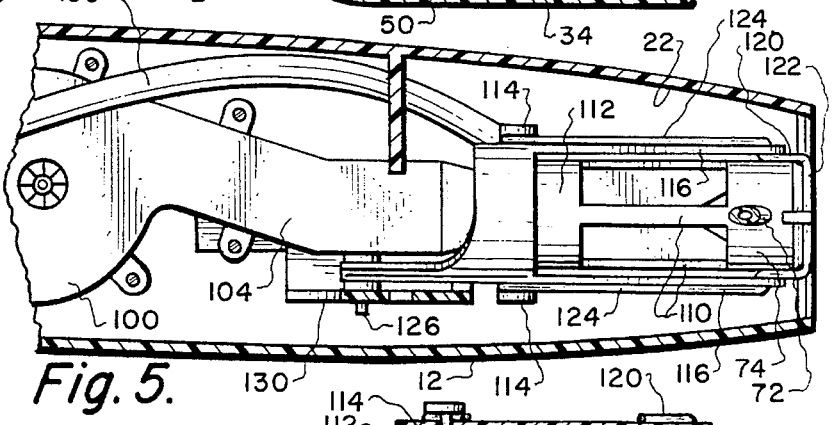
FIG. 5 is a cross-sectional view showing in more detail the film producing mechanism utilized within the bubble producing toy of the present invention taken along line 5—5 of FIG. 3.
Figure 6:
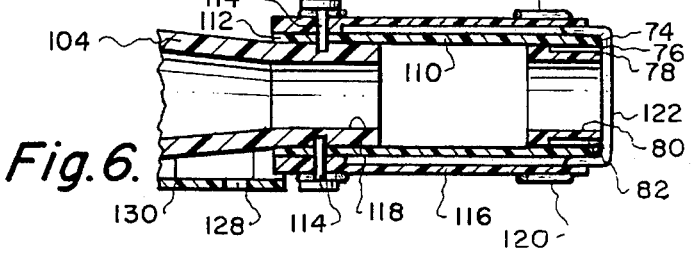
FIG. 6 is a cross-sectional view taken along line 6—6 of FIG. 3 showing more clearly the film producing mechanism utilized within the bubble producing toy of the present invention.

The exterior wall surface of the sleeve insert 78 is formed to include a plurality of small spaced-apart holes 82 that connect with the annular chamber 76. These holes 82, which can only be seen in FIG. 2 of the drawings, are to supply the liquid from the annular chamber 76 to the dispensing surface 84 of the sleeve 74. Any excess liquid from the dispensing surface 84 will flow onto drip rod 86 and then be gravitationally deposited within funnel 88. From funnel 88 the liquid is to be conducted past check valve 90 which normally covers the drain hole 92 of the funnel 88. Negative pressure caused by the transfer of the liquid 68 through the suction tube 61 will cause the check valve 90 to deflect slightly away from the outlet hole 92 permitting the liquid to drain back into the reservoir 66. Check valve 90 prevents leakage exteriorly of the housing 12 if the toy 10 is turned sideways or upside down. The check valve 90 is mounted by mounting block directly to the cap 62. Access into the batteries 28 is provided by means of a battery cap 96 which is removably mounted on the housing 12. In order to gain access to the battery cap 96, the reservoir 66 has to be disengaged from the cap 62.

Air is to be moved from within the internal chamber 22 through through hole 98 of the fan housing 100. The fan housing 100 is fixedly positioned to the housing 12 within the internal chamber 22. The air that is moved as depicted by arrows 102 is moved through channel 104 in close proximity to the sleeve 74. The air is then moved through the center opening 80 into the ambient with this air movement being depicted by arrow 106. Upon there being a thin film of the liquid 68 placed across the center opening 80 by the applicating bar 122, a bubble 108 will be formed and dispensed into the ambient as shown in FIG. 1. Variation in air speed will affect bubble size and volume.

The sleeve 74 is integral with an extension 110. The extension 110 connects to mounting ring 112. Mounting ring 112 is mounted in a tight manner on the channel 104. Pivotally mounted by means of pins 114 onto the mounting ring 112 and the channel 104 are a pair of arms 116. The arms 116 are located diametrically opposite each other relative to the channel opening 118 formed within the channel 104. Mounted on the arms 116 is a U-shaped wire rod 120. The U-shaped wire rod 120 includes an outer end forming applicating bar 122 which is to be located continuously flush against the dispensing surface 84. In order to maintain this applicating bar 122 in continuous contact with the dispensing surface 84, it is necessary to have the applicating bar 122 be under a continuous bias toward the dispensing surface 84. This is achieved by incorporating within the wire rod 120 bowed sections 124 with the bowed sections 124 creating an inherent resiliency that holds the applicating bar 122 into continuous contact with the dispensing surface 84. This continuous contact is maintained even during the pivoting movement of the arms 116 about the pivot pins 114. Arms 116 are always pivoted together. One of the arms 116 is mounted by guide pin 126 within a slot 128 of a guide plate 130. The guide plate 130 is fixedly mounted on the trigger 20.

Figure 3:
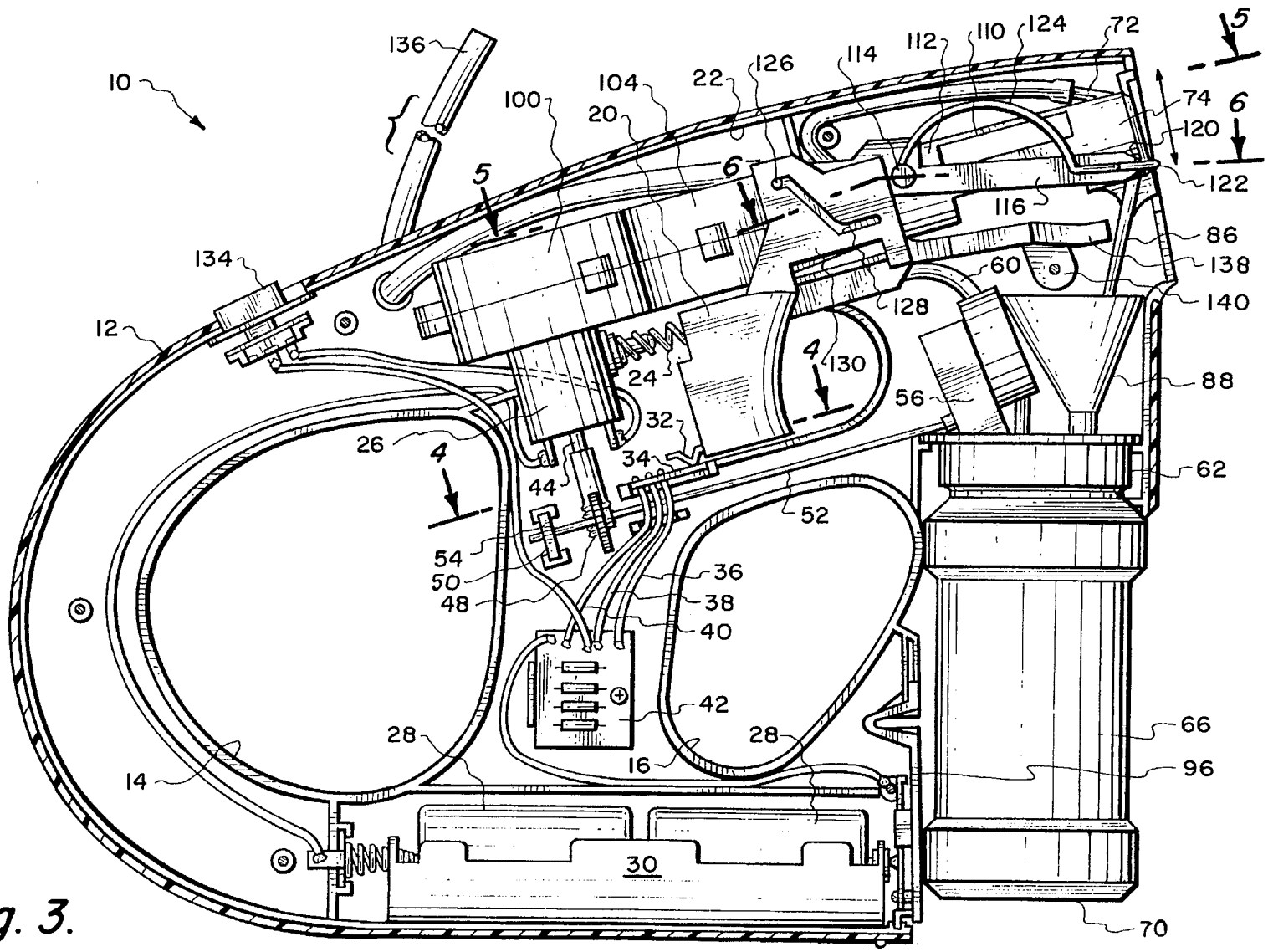
FIG. 3 is a longitudinal cross-sectional view of the bubble producing toy of the present invention taken along line 3—3 of FIG. 2 showing the toy in the inactivated position.
Figure 7:
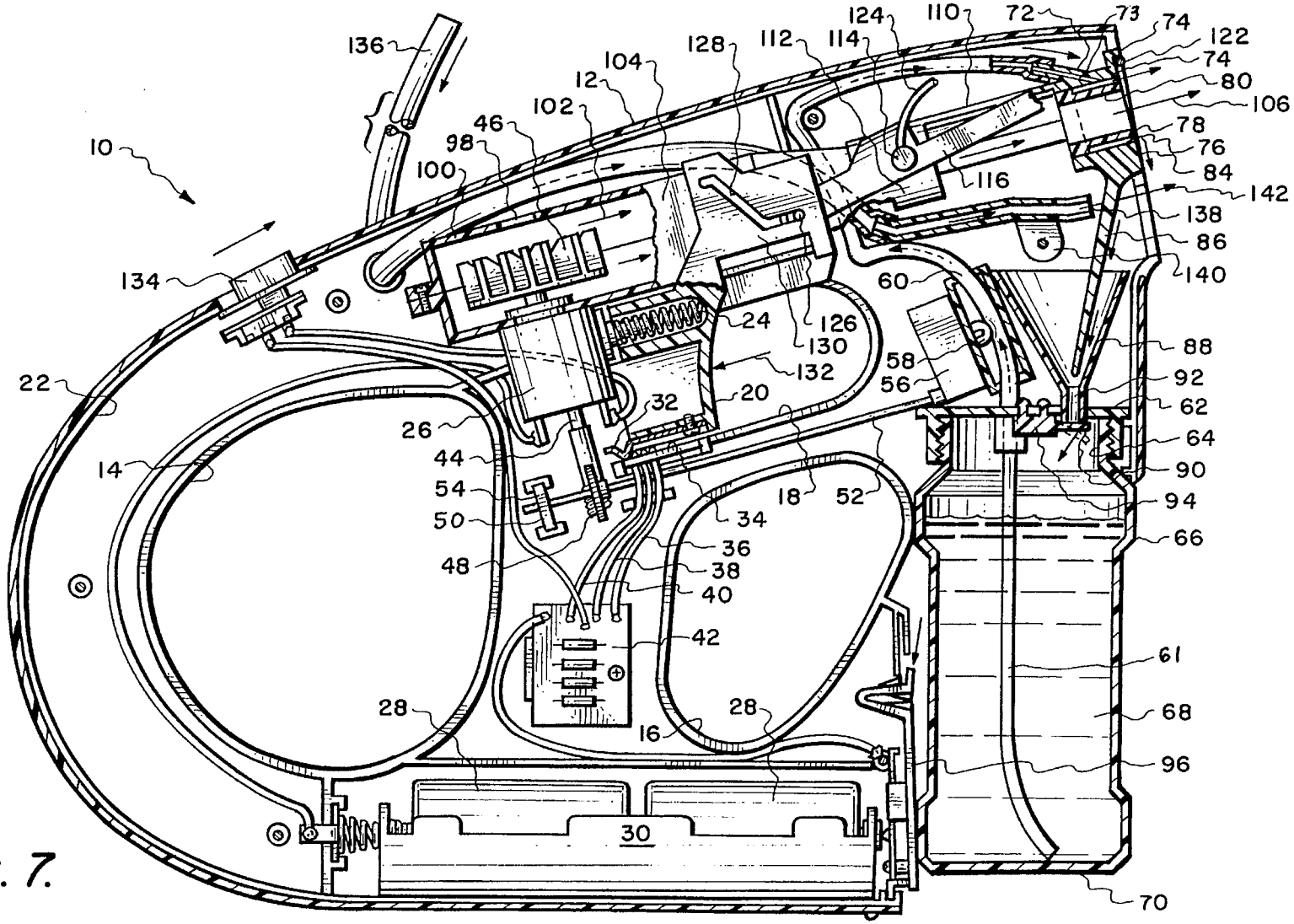
FIG. 7 is a longitudinal cross-sectional view similar to FIG. 3 but with the trigger mechanism located in the activated position.

Lineal movement of the trigger 20 from the position shown in FIG. 3 in the direction of arrow 132, as is shown in FIG. 7, will result in the guide pin 126 moving within the slot 128. This causes the arms 116 to pivot approximately twenty-five to thirty degrees. This moves the applicating bar 122 across the dispensing surface 84, and with each movement there across an attempt is made to place a thin film of the liquid 68 across the dispensing surface 84. When this thin film of liquid is pushed against by the air being conducted through the center opening 80, the film is dislodged from the dispensing surface 84 which encloses forming the bubble 108. The user, by the single action of operating a lineally moving of the trigger 20, operates the motor within the motor housing 26 which in turn moves the air by means of the fan blade 46 and pumps the liquid 68 from the reservoir 66 to the annular chamber 76. Also as previously mentioned, this movement of the trigger 20 produces the applicating action of the applicating bar 122 of the rod 120. It is to be understood that when the trigger 20 is released, the applicating bar 122 returns to its at rest position and there is no longer any electrical operation of the motor within the motor housing 26 or the pump in pump housing 56.

There is incorporated a switch 134 mounted within the housing 12 which when moved to an activating position, operates the motor within the motor housing 26 regardless of the position of the trigger 20. In essence the switch 134 can be moved to continuously operate the motor within the motor housing 26 bypassing the trigger 20.

When the user wishes to propel the bubbles 108 a greater distance than normal from the toy 10 of this invention, the user can utilize tube 136. The user places the outer end of tube 136 within the user's mouth and blows, which causes air to flow through the tube 136 which is located within the internal chamber 22 with the outer end 138 of the tube 136 being fixedly mounted by bracket 140 to the wall of the internal chamber 22. The outer end 138 of the tube 136 directs this flow of booster air in the direction of arrows 142 which comes into contact with the bubbles 108 as they are propelled from the dispensing surface 84. This boosting flow of air pushes the bubbles 108 a substantial distance from the toy 10. It is to be understood that usage of the tube 136 is deemed to be optional.

What is claimed is:

1. A bubble producing toy comprising:

a housing having an internal chamber;

a dispensing opening connecting with said internal chamber, said dispensing opening connecting to the ambient, a sleeve mounted within said dispensing opening, said sleeve having a central opening and a dispensing surface;

a reservoir mounted on said housing, said reservoir to contain a liquid, said liquid being capable of producing air bubbles;

a pump mounted within said housing, said pump connected to said reservoir by a tube to supply said liquid to said pump;

a source of blown air originated from within said internal chamber, said source to be dispensed into said central opening of said sleeve into the ambient;

a film producing mechanism mounted on said housing, said film producing mechanism including an applicating bar, said applicating bar being located against said dispensing surface, said applicating bar being movable across said dispensing surface, said liquid from said reservoir to be moved by said pump to said dispensing surface, whereby said applicating bar locates a thin film of said liquid across said dispensing surface as said applicating bar is moved across said dispensing surface which creates an air bubble upon said source flowing through said thin film mounted across said central opening.

2. The bubble producing toy as defined in claim 1 wherein:

said applicating bar being biased into continuous contact with said dispensing surface.

3. The bubble producing toy as defined in claim 1 wherein:

a separate boosting air source connected to said housing, said boosting air source originating exteriorly of said housing, said boosting air source to be dispensed directly adjacent said sleeve but exteriorly thereof, said boosting air source functioning to cause greater propelling into the ambient the bubbles that are produced from said sleeve.

4. The bubble producing toy as defined in claim 3 wherein:

said separate boosting air source comprising a flexible tube which has an open outer end which is designed to be connected to the mouth of the user of said bubble producing toy.

5. The bubble producing toy as defined in claim 1 wherein:

a drip rod being mounted within said housing, said drip rod being connected to said sleeve, unused liquid is to be conducted by said drip rod into a catching funnel, said catching funnel being located within said internal chamber and connected to said reservoir, any unused liquid is to be caused to flow through said catching funnel back into said reservoir.

6. A bubble producing toy comprising:

a housing having an internal chamber;

a dispensing opening connecting with said internal chamber, said dispensing opening connecting to the ambient, a sleeve mounted within said dispensing opening, said sleeve having a central opening and a dispensing surface;

a reservoir mounted on said housing, said reservoir to contain a liquid, said liquid being capable of producing air bubbles;

a pump mounted on said housing, said pump being connected to said reservoir;

a source of blown air originated from within said internal chamber, said source to be dispensed into said central opening of said sleeve into the ambient;

a film producing mechanism mounted on said housing, said film producing mechanism including an applicating bar, said applicating bar being located against said dispensing surface, said applicating bar being movable across said dispensing surface, said liquid from said reservoir to be moved by said pump to said dispensing surface, whereby said applicating bar locates a thin film of said liquid across said dispensing surface as said applicating bar is moved across said dispensing surface which creates an air bubble upon said source flowing through said thin film mounted across said central opening; and said source of blown air being produced by a fan, said fan being mounted within said internal chamber of said housing, said fan being operated by an electrical motor, said pump being operable to move said liquid to be dispensed at said sleeve, said electrical motor also operating said pump.

7. The bubble producing toy as defined in claim 6 wherein:

said fan and said pump being operated simultaneously by said motor.

8. The bubble producing toy as defined in claim 7 wherein:

said housing including an activating switch, manual movement of said activating switch causes activation of said motor and said pump.

9. The bubble producing toy as defined in claim 8 wherein:

said activating switch comprising a trigger mechanism.

10. The bubble producing toy as defined in claim 6 wherein:

said electrical motor being connected to a plurality of electrical contacts which cause said electrical motor to be operable at a plurality of different speeds by means of a manually operated switch which connects with said electrical contacts.

11. A bubble producing toy comprising:

a housing having an internal chamber;

a dispensing opening connecting with said internal chamber, said dispensing opening connecting to the ambient, a sleeve mounted within said dispensing opening, said sleeve having a central opening and a dispensing surface;

a reservoir mounted on said housing, said reservoir to contain a liquid, said liquid being capable of producing air bubbles;

a pump mounted on said housing, said pump being connected to said reservoir;

a source of blown air originated from within said internal chamber, said source to be dispensed into said central opening of said sleeve into the ambient;

a film producing mechanism mounted on said housing, said film producing mechanism including an applicating bar, said applicating bar being located against said dispensing surface, said applicating bar being movable across said dispensing surface, said liquid from said reservoir to be moved by said pump to said dispensing surface, whereby said applicating bar locates a thin film of said liquid across said dispensing surface as said applicating bar is moved across said dispensing surface which creates an air bubble upon said source flowing through said thin film mounted across said central opening;

said applicating bar being biased into continuous contact with said dispensing surface, said applicating bar being pivotally mounted on said housing; and said source of blown air comprising a fan being operated by an electrical motor, a pump mounted within said housing, said pump being connected to said reservoir, said pump being operable to move said liquid to be dispensed at said sleeve, electricity being supplied to said electrical motor to operate said electrical motor, said electrical motor also operating said pump.

12. The bubble producing toy as defined in claim 11 wherein:

a trigger actuating switch being mounted on said housing, manual movement of said trigger actuating switch causes simultaneous operation of said electrical motor and said pump as well as movement of said applicating bar across said dispensing surface due to a linkage connection between said trigger actuating switch and said applicating bar, said pump and said electrical motor.

13. The bubble producing toy as defined in claim 12 wherein:

said applicating bar comprising a thin rod.

14. A bubble producing toy comprising:

a housing having an internal chamber;

a dispensing opening connecting with said internal chamber, said dispensing opening connecting to the ambient, a sleeve mounted within said dispensing opening, said sleeve having a central opening and a dispensing surface;

a reservoir mounted on said housing, said reservoir to contain a liquid, said liquid being capable of producing air bubbles;

a pump mounted on said housing, said pump being connected to said reservoir;

a source of blown air originated from within said internal chamber, said source to be dispensed into said central opening of said sleeve into the ambient;

a film producing mechanism mounted on said housing, said film producing mechanism including an applicating bar, said applicating bar being located against said dispensing surface, said applicating bar being movable across said dispensing surface, said liquid from said reservoir to be moved by said pump to said dispensing surface, whereby said applicating bar locates a thin film of said liquid across said dispensing surface as said applicating bar is moved across said dispensing surface which creates an air bubble upon said source flowing through said thin film mounted across said central opening;

a drip rod being mounted within said housing, said drip rod being connected to said sleeve, unused liquid is to be conducted by said drip rod into a catching funnel, said catching funnel being located within said internal chamber and connected to said reservoir, any unused liquid is to be caused to flow through said catching funnel back into said reservoir; and there being a one-way valve mounted between said catching funnel and said reservoir that only permits liquid to be conducted from said catching funnel into said reservoir.

15. The bubble producing toy as defined in claim 14 wherein:

said reservoir being sealed from the ambient air so that removal of liquid from said reservoir creates negative pressure within said reservoir which aids in the return of unused liquid from said drip bar while operating the toy, thereby minimizing leakage of liquid through said one-way valve when said toy is not in operation or if said toy is mishandled during operation.

* * * * *